114-253 SR

1/6/81 OR 4,242,978

United States Patent [19]

Fuller

[11] 4,242,978

[45] Jan. 6, 1981

[54] HOOK ASSEMBLY FOR RETRIEVING THE CHAIN BRIDLE COMPONENT OF BROKEN MARINE VESSEL TOWING LINES

[76] Inventor: Orville A. Fuller, 995 Oakway Dr., Coos Bay, Oreg. 97420

[21] Appl. No.: 925,457

[22] Filed: Jul. 17, 1978

[51] Int. Cl.[3] ..... B63B 21/04

[52] U.S. Cl. ..... 114/253; 294/66 R

[58] Field of Search ..... 114/221 R, 221 A, 242, 114/253, 293, 294, 267, 243-252; 405/154; 294/66 R, 82 R

[56] References Cited

U.S. PATENT DOCUMENTS

| | | | |
|---|---|---|---|
| 1,378,102 | 5/1921 | Froger | 114/253 |
| 3,268,967 | 8/1966 | Jordan | 294/82 R |
| 3,804,177 | 4/1974 | Renfroe | 114/267 |
| 3,927,636 | 12/1975 | Childers et al. | 294/66 R |
| 4,037,555 | 7/1977 | Berman | 114/253 |
| 4,124,181 | 11/1978 | Kolwey | 294/66 R |

FOREIGN PATENT DOCUMENTS

| | | | |
|---|---|---|---|
| 77903 | 1/1951 | Norway | 294/66 R |

*Primary Examiner*—Edward R. Kazenske
*Assistant Examiner*—Jesús D. Sotelo
*Attorney, Agent, or Firm*—Eugene D. Farley

[57] ABSTRACT

A hook assembly for retrieving the chain bridle component of a broken marine barge towing line. The assembly comprises a sinking hook dimensioned to receive the bridle, a float connected to the hook for maintaining it a predetermined distance below the surface of the water, and a hook towing line connected to the hook for deploying it into position for intercepting and engaging the bridle. Hook positioning means locates the hook in bridle-engaging position.

4 Claims, 4 Drawing Figures

HOOK ASSEMBLY FOR RETRIEVING THE CHAIN BRIDLE COMPONENT OF BROKEN MARINE VESSEL TOWING LINES

BACKGROUND AND SUMMARY OF THE INVENTION

This invention relates to apparatus for retrieving the tow lines of marine vessels such as barges and ships which have broken loose from a towing tug, leaving their tow lines dangling freely in the water.

In the operation of tugs and barges, particularly of ocean going tugs and barges, use is made of a nylon or cable tow line connected to the barge through a chain bridle. Because of the heavy loads imposed upon it, it is not uncommon for the tow line to break.

Since this mishap often occurs under storm conditions, when the winds are high and the seas are mountainous, the recapture of the towed vessel presents a serious and hazardous problem. A particular problem is presented for the reason that in the usual situation crewmen are not aboard the towed vessel. Barges customarily are unmanned when they are under tow.

Accordingly, one method of recapturing a barge which has broken loose from its tug is to transfer one or more crewmen from the tug to the barge, and then re-establish the tow by the use of heaving lines. In view of adverse weather and sea conditions, this is a difficult and dangerous assignment which may be impossible of fulfillment until the prevailing conditions of sea and weather have improved. It also may leave the crewmen aboard the barge for the duration of transit, under uncomfortable and unhealthful conditions.

A second method of recapturing a barge which has broken loose is through the use of an "insurance line".

This method is used widely at the present time. It requires the use and continual presence on the barge of an auxiliary or spare barge-towing cable tacked to the deck of the barge. One end of the towing cable is connected to the conventional bitt located off center on one side of the barge for attachment of one leg of the conventional towing bridle. The other end of the cable is coupled to a float-towing line which trails behind the barge when the barge is underway.

If the working tow line should break, the tug circles the barge, picks up the float-towing line, rips loose the spare towing cable from the barge deck, and couples it to the residual working towing cable. It then proceeds with the tow, using the "insurance line" as the tow cable.

This system has at least two serious defects.

First, since the "insurance line" on the deck of the barge is continually exposed to the elements and to salt spray, it corrodes rapidly and often is in no condition for service when the emergency arises. Upon being connected to the working towing line of the tug, it breaks and the problem of a loose barge is still present.

Second, even if the "insurance line" is in good condition and does not fail, it tows the barge in a unsatisfactory and sometimes dangerous manner.

As noted, the barge end of the "insurance line" is fastened to one of the off-center towing bitts of the barge to which one leg of the barge-towing bridle is connected. Accordingly, when the barge is towed by the single "insurance line", connected off-center of the barge, the barge tends to shear and will not tow straight. As a result, it is difficult to control.

It accordingly is the general object of this invention to provide an assembly for retrieving broken towing lines from barges and ships and to reestablish the tow.

Other objects are the provision of such an assembly which is characterized by the following advantages:

1. Continuously functional.
2. Free from the danger of damage by exposure to salt water.
3. Easy and safe to use.
4. Avoids the necessity of transferring crewmen to the derelict barge.
5. Establishes a strong hookup with the barge.
6. After re-establishment of the tow, pulls the barge efficiently from the center so that it does not shear when underway.
7. Capable of use under adverse weather conditions and in high seas.
8. Has a long service life.

The foregoing and other objects of this invention are achieved by the provision of an assembly which, generally stated, comprises hook means dimensioned to receive and engage the chain bridle component of a broken barge tow line, float means connected to the hook for maintaining it at a predetermined distance below the surface of the water, and a hook towing line connected to the hook means for deploying it into position for intercepting and engaging the bridle. The assembly includes hook positioning means connecting the hook to the hook towing line. This serves to position the hook in engaging position relative to the bridle.

The device normally is stowed away aboard the tug. When the occasion for its use arises, it is thrown overboard and its tow line paid out. The tug encircles the derelict vessel until the hook engages the chain bridle dangling from the bow of the barge or other vessel under tow. The tow then can be continued in normal manner.

DESCRIPTION OF A PREFERRED EMBODIMENT OF THE INVENTION

Figure 2:
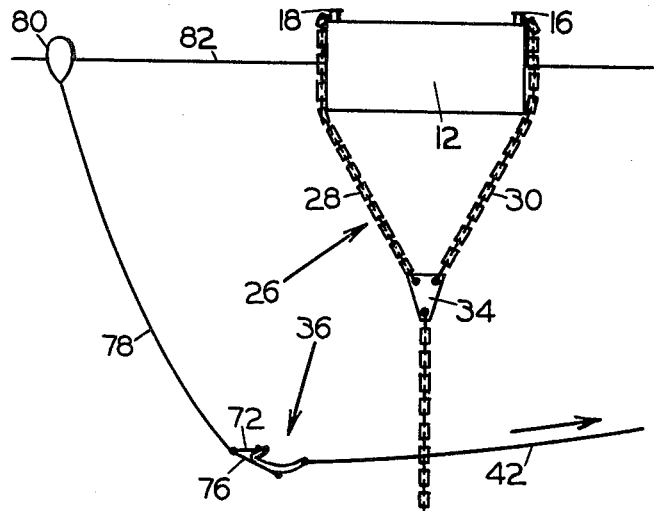
FIG. 2 is a schematic view illustrating the manner in which the presently described hook assembly intercepts and engages the chain bridle as it dangles from the bow of the barge.
Figure 1:
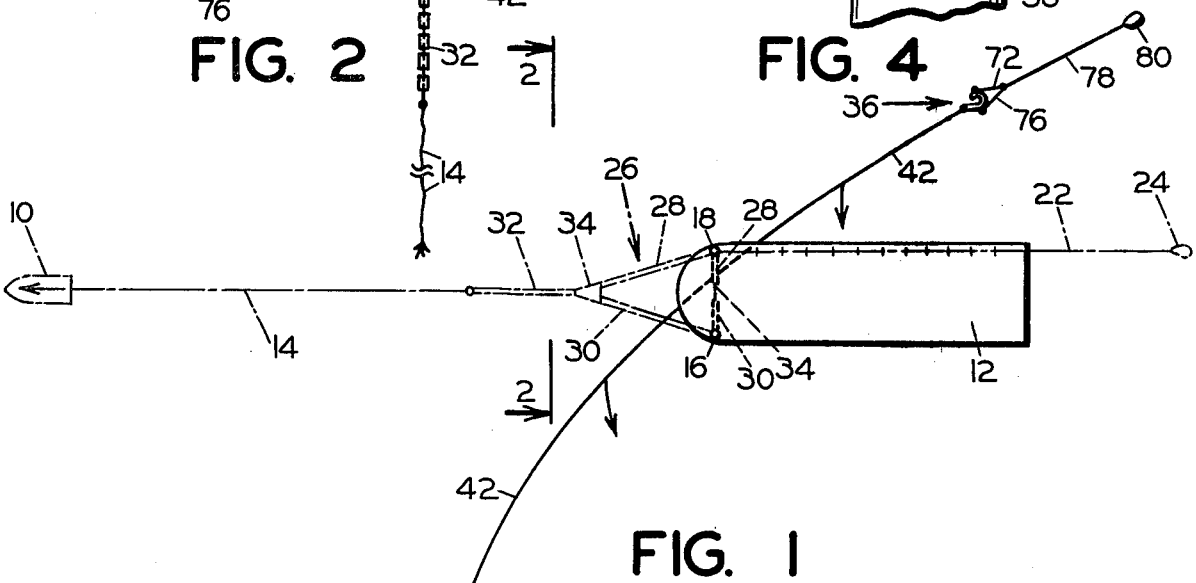
FIG. 1 is a schematic view of a tug and barge, the tug being illustrated in dashed outline in its normal towing position relative to the barge and in solid outline in retrieving position. The tow line and its associated bridle are indicated in dashed outline in their normal towing position and the bridle only is indicated in dotted outline in its broken, vertically dangling condition.

As illustrated schematically in FIGS. 1 and 2, the tug 10 normally tows the barge or other vessel 12 by means of a barge tow line 14. The barge is equipped in the usual manner with port and starboard towing bitts 16, 18. It is to one or the other of these towing bitts that the conventional "insurance line" 22 and associated float 24 described above are connected.

Barge tow line 14 comprises a length of heavy cable, chain or Nylon rope. It is connected to the barge by means of a heavy chain bridle 26 consisting of chain segments 28, 30, 32. Segments 28, 30 interconnect bitts 18, 16 respectively and a bridle plate 34. Segment 32 is coupled to tow line 14.

Figure 4:
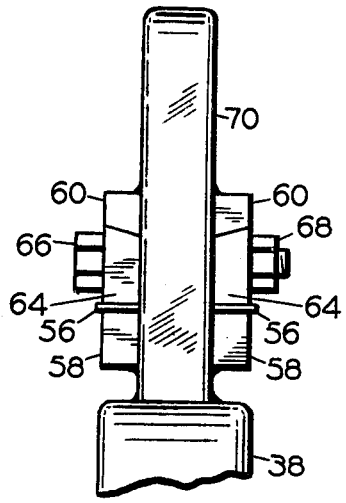
FIG. 4 is a fragmentary view in elevation looking in the direction of the arrows of line 4—4 of FIG. 3.
Figure 3:
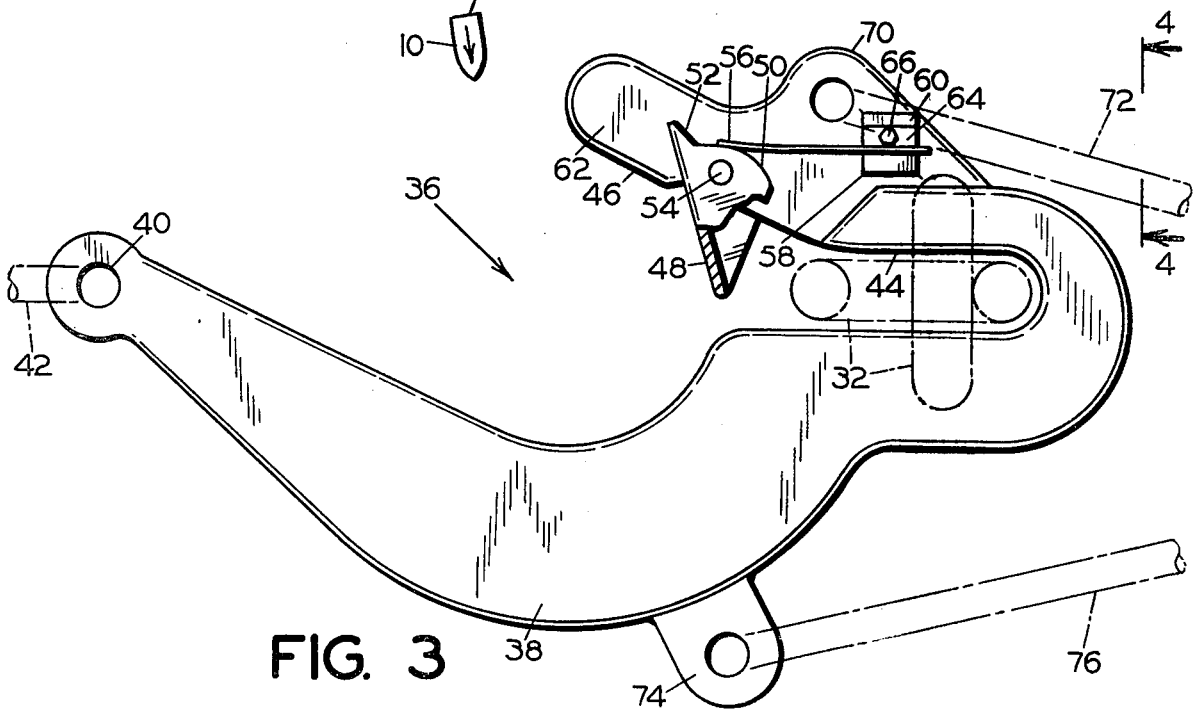
FIG. 3 is a plan view of the bridle-retrieving hook assembly of the present invention.

The retrieving hook assembly 36 of my invention is illustrated in detail in FIGS. 3 and 4.

It comprises a massive, flat, hook-shaped member 38 from two to four feet in overall length and fabricated from corrosion-resistant metal. An eye 40 at its shank end connects with a hook towing line 42. Its hook end is shaped with an insertion slot 44 dimensioned to receive and engage a single link of bridle chain segment 32. Angled guide surface 46 assists in guiding the chain into the insertion slot.

Detent means are provided for releasably retaining chain 32 in insertion slot 44.

In the illustrated form of the invention the detent means comprises a spring-pressed detent 48 having a camming surface 50 and a manipulating tab 52. The detent is dimensioned and positioned to lie across insertion slot 44 when in its advanced position, retaining chain 32 in the slot, and to be withdrawn from slot 44 when in its retracted position, permitting removal of the chain from the slot.

To this end the detent is pivotally mounted on a pivot pin 54 and spring-pressed by leaf springs 56.

The outer ends of springs 56 bear against cam surface 50 of the detent. Their inner ends are removably mounted (for replacement when needed) in a wedge block assembly illustrated particularly in FIG. 4.

This assembly includes a first pair of mounting blocks 58 and a second pair of mounting blocks 60 welded to opposite side faces of a hook extension 62, in spaced relation to each other. The inner surfaces of mounting blocks 58 are flat and support springs 56. The opposed inner surfaces of mounting block 60 are tapered.

Wedges 64 having lower flat surfaces and upper tapered surfaces fit in the spaces between mounting blocks 58, 60 where they are releasably retained by bolt 66 and nut 68. The clearances are such that tightening down on the nut clamps the springs against mounting blocks 58, which accordingly serve as bases or beds against which the springs bear.

Hook positioning means are provided for positioning hook 38 in engaging position relative to the barge towing line, specifically relative to towing bridle segment 32. This purpose is accomplished by the provision of a float-bridle assembly the construction of which is illustrated in FIGS. 2 and 3.

Hook extension 62 is formed with an ear 70 to which is fastened float bridle segment 72. The mid-section of hook 38 mounts an oppositely extending tab 74 to which is fastened the companion float bridle segment 76. The two bridle segments are suitably coupled to a float tow line 78 the free end of which is connected to a float 80. The length of the float tow line 78 is predetermined so that the float supports the retrieving hook assembly at a depth relative to the surface 82 of the water at which it will intercept when in use segment 32 of barge tow bridle assembly 26.

OPERATION

In the event that the barge tow line should break during a tow, the towing bridle 26 and severed tow line segment 14 will assume the positions of FIG. 2 (and the dotted line position of FIG. 1) with segment 32 of the bridle extending substantially vertically, deep in the water beneath barge 12.

The tug operator then will reel in the free segment of the broken barge tow line and toss overboard, the retrieving hook assembly including hook 36, hook tow line 42 and float 80. He will pay out hook tow line 42 to a suitable extent and then proceed to tow the assembly on a course, illustrated in full line in FIG. 1, calculated to intercept with hook 36 the barge bridle segment 32. During this tow, float 80 will maintain the hook at the proper depth and the associated float bridle consisting of segments 72, 76 will maintain the hook in a substantially horizontal position. In this position, the hook opening, and in particular insertion slot 44, will be presented properly to the vertically oriented chain, all as illustrated in FIG. 2.

When the hook engages the chain, the chain link concerned will slip past the detent 48 in slot 44 where it will be retained by the detent. The towing condition of the barge relative to the tug thus is re-established, with the tug towing the barge through its towing bridle 26 in normal manner. Furthermore, the desired relationship is established quickly, safely, under any weather and sea conditions, and without the necessity of putting one or more crewmen aboard the barge.

Having thus described my invention in preferred embodiment, I claim:

1. A hook assembly for retrieving marine vessel towing lines comprising a cable component and associated chain bridle component, the hook assembly comprising:
   (a) hook means dimensioned to receive and engage the chain bridle component of the towing line,
   (b) float means connected to the hook means for maintaining the same a predetermined distance below the surface of the water, the float means comprising a float towing line, a float connected to one end of the float towing line, a bridle connected to the other end of the float towing line, and bridle connecting means connecting the bridle to opposite sides of the hook means, and
   (c) a hook towing line connected to the hook means for deploying the same into position for intercepting and engaging the chain.

2. A hook assembly for retrieving marine vessel towing lines comprising a cable component and associated chain bridle component, the hook assembly comprising:
   (a) hook means dimensioned to receive and engage the chain bridle component of the towing line, the hook means comprising a hook having an insertion slot dimensioned to receive and engage a link of chain bridle, spring pressed chain-detent means positioned across the mouth of the insertion slot, the detent means comprising a detent having a camming surface and a manipulating tab, a pivot pin pivotally mounting the detent on the hook means, leaf spring means bearing on the camming surface for maintaining the detent in a normally closed position, and leaf spring mounting means mounting the leaf spring means on the hook means a spaced distance from the detent,
   (b) float means connected to the hook means for maintaining the same a predetermined distance below the surface of the water, and
   (c) a hook towing line connected to the hook means for deploying the same into position for intercepting and engaging the chain bridle component of the vessel towing line.

3. The hook assembly of claim 2 wherein the leaf spring mounting means comprises bolt-operated wedge block means.

4. A hook assembly for retrieving the chain bridle component of a broken marine vessel towing line, the hook assembly comprising:

(a) a hook member having an insertion slot dimensioned to receive flatwise therein a link of the chain bridle component of the towing line, (b) a float member, (c) a float tow line interconnecting the hook and float members and dimensioned to maintain the hook member a distance below the surface of the water predetermined to intercept the vertically depending chain bridle, the float tow line including a pair of bridle lines connected to the hook member for orienting the insertion slot of the hook member in chain link receiving position, and (d) a hook towing line connected at one end to the hook member and arranged for connection at its opposite end to a towing vessel for moving the hook member for intercepting and engaging the chain bridle component of the vessel towing line.

* * * * *